United States Patent [19]

Loveless et al.

[11] Patent Number: 4,868,949

[45] Date of Patent: Sep. 26, 1989

[54] ASH VACUUM ADAPTER

[76] Inventors: Michael L. Loveless; Colleen G. Loveless, both of 449 E. 200 North, Price, Utah 84501

[21] Appl. No.: 275,930

[22] Filed: Nov. 25, 1988

[51] Int. Cl.[4] ..... A47L 9/20

[52] U.S. Cl. ..... 15/352; 55/305

[58] Field of Search ..... 15/352, 357; 55/305

[56] References Cited

U.S. PATENT DOCUMENTS

| | | | |
|---|---|---|---|
| 1,946,665 | 2/1934 | Bieth | 55/305 |
| 3,910,781 | 10/1975 | Bryant | 55/305 |
| 4,342,131 | 8/1982 | Reid | 15/352 X |
| 4,355,434 | 10/1982 | Gongwer | 15/352 X |
| 4,476,608 | 10/1984 | Rasmussen | 15/352 X |

FOREIGN PATENT DOCUMENTS

| | | | |
|---|---|---|---|
| 294501 | 7/1928 | United Kingdom | 55/305 |

*Primary Examiner*—Chris K. Moore

*Attorney, Agent, or Firm*—M. Reid Russell

[57] ABSTRACT

An ash vacuum adapter for connection to a vacuum source to pull warm to even hot and burning ashes and small coals through a fire retardant hose, the ashes and coals deposited in a canister housing that is supported on rollers or casters. The vacuum source is connected to the canister housing to pull a vacuum through a flexing filter that is arranged in the canister housing, which flexible filter is formed from a cylindrical sleeve manufactured from a fireproof or flame retardant material that is closed across a bottom end by a metal base. The vacuum source is directed through the cylindrical sleeve that includes a dew-rod fitted therethrough that has one end connected to the metal base, the other dew-rod end extending beyond the canister housing lid for manual movement.

6 Claims, 3 Drawing Sheets

ASH VACUUM ADAPTER

BACKGROUND OF THE INVENTION

1. Field of The Invention

The present invention relates to vacuum devices for cleaning both hot and cold burned materials out of a fireplace or stove and particularly to adapters for serial use with a standard vacuum source.

2. Prior Art

The cleaning out of ashes and coals from wood burning fireplaces and stoves is a chore that is generally messy and sometimes constitutes a fire hazard. For example, for safe fireplace and stove cleaning, the ashes and coals should be removed only when cold. Also, ash removal is rarely accomplished without a discharge of dust into the surrounding air and/or a spilling of ashes during the removal of that ash and its transport for disposal. The present invention provides a vacuum apparatus for safely and reliably removing warm and even hot ashes and coals from a fireplace or stove.

A number of vacuum operated devices have heretofore been developed to solve some of the above set out problems and difficulties, none of which anticipate the arrangement of the present invention. For example, a patent to Raminger, U.S. Pat. No. 2,531,920, shows an early canister vacuum or suction device for collecting ashes that employs an external ash dust collection bag that is unlike the filter arrangement of the present invention. Further, patents to Reid, U.S. Pat. No. 4,342,131, and Gongwer, U.S. Pat. No. 4,355,434, show suction canister type cleaners that employ heat resistant filters. These devices, however, lack an arrangement for cleaning such filter without dismantling the device. A patent to Fullenwider, U.S. Pat. No. 4,363,674, shows a vacuum device that pulls ashes through a hose to deposit them in a water bath, and does not include a filter.

The above set out patents, of course, deal with canister vacuum arrangements. Whereas, the present invention is in an adapter that can utilize a canister vacuum, shop-vacuum, or like arrangement as a vacuum source. A patent to Rasmussen, U.S. Pat. No. 4,476,608, shows a canister that utilizes a partition plate in lieu of a filter; and a patent to Natale, U.S. Pat. No. 4,613,348, shows a filtration canister with filter that is disposable. Neither of these adapters, however, include a filter arrangement that can be cleaned without dismantling the device like that of the present invention.

SUMMARY OF THE INVENTION

It is a principal object of the present invention to provide a vacuum operated apparatus for safely and conveniently removing warm and even hot ashes from a wood burning fireplace or stove.

Another object of the present invention is to provide an adapter for use with a vacuum source to pull ashes and small coals that may be very hot through a nozzle and flame retardant hose and are deposited in a canister body of the adapter for disposal.

Another object of the present invention is to provide an adapter having a canister body and hose arrangement for arrangement with a vacuum source for pulling ashes and coals into that canister body, the vacuum source protected by a flame resistant filter arrangement.

Still another object of the present invention is to provide a manually operable arrangement for shaking the filter to dislodge ash particles therefrom as could interfere with the filter efficiency.

Still another object of the present invention is to provide an adapter and hose therefore that is capable of removing under vacuum, even hot to burning ash and coals from a fireplace or wood burning stove, a metal canister body thereof supported above a surface as for example a carpet, that could be damaged by a heat build up within which canister body.

The present invention is in an adapter that includes a canister body and lid therefore, the canister body arranged for connection through a hose to a vacuum source. The canister body also includes a flame retardant hose and nozzle end therefore to pull ashes and even hot coals from a fireplace or wood burning stove that are deposited in the canister body. The vacuum created in the canister body is pulled through a filter arranged therein. The filter is constructed from a metal base plate whereto is mounted one end of a sleeve that is formed from a flame retardant fabric with the other sleeve end secured to the under surface of the canister body lid, that lid for closing, in sealing engagement, over the canister body open top end.

A dew-rod, that is a section of a straight rod, is secured at approximately a right angle to the center of the metal base plate. The dew-rod extends longitudinally within the sleeve, and passes through an opening in the canister body lid. A dew-rod seal is provided for maintaining a vacuum within that canister when the dew-rod is not in use. For cleaning the filter, by shaking ash dust therefrom, the dew-rod is manually drawn up and down. The metal base plate to move with the dew-rod travel, flexing the filter sleeve so as to shake collected ash particles therefrom that fall into the bottom of the canister body.

The canister body is preferably a metal drum to resist burning, is mounted on casters, or the like, to maintain its bottom end above the ground. The canister body preferably includes clamps, or the like, for releasably locking the lid, in sealing engagement, thereover.

BRIEF DESCRIPTION OF THE DRAWINGS

These and other objects and features of the present invention will become more apparent from the following description in which the invention is described in detail in conjunction with, the accompanying drawings.

DETAILED DESCRIPTION

Figure 1:
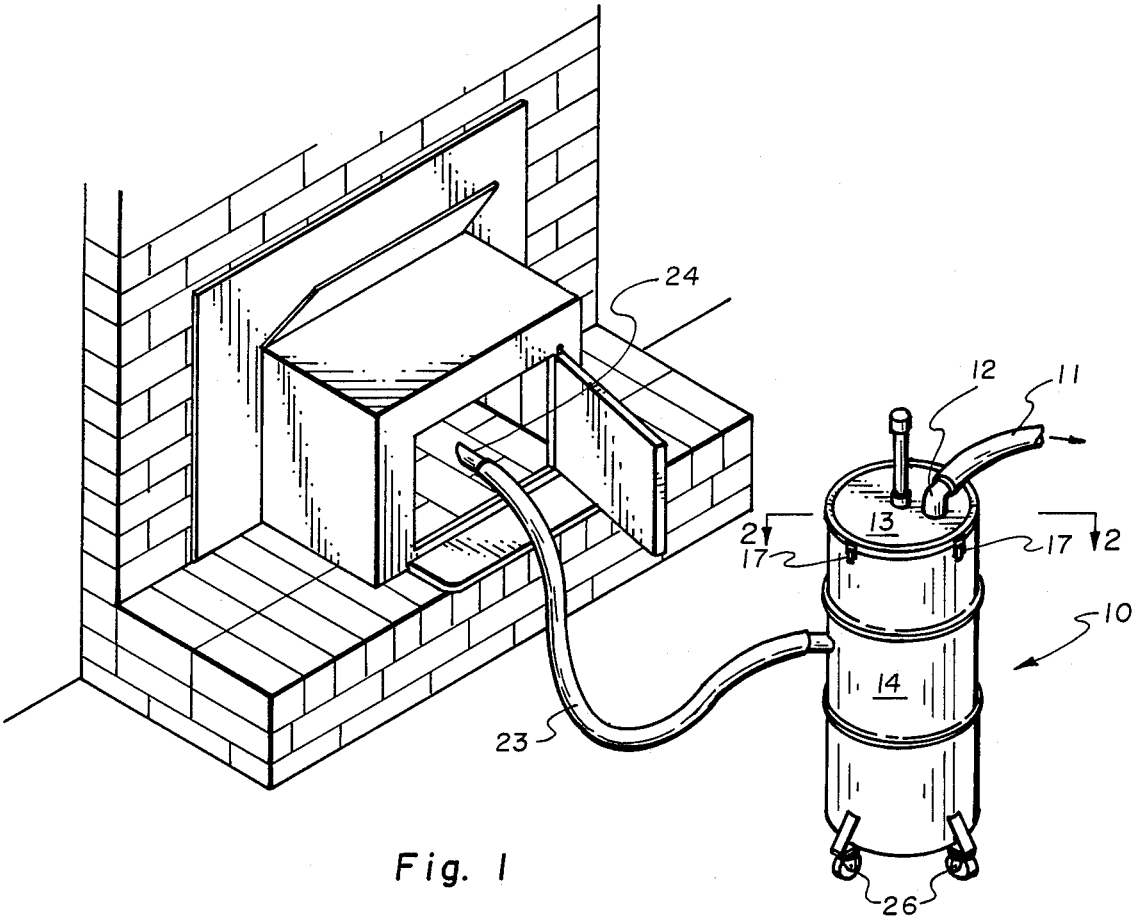
FIG. 1 is a perspective view of an ash vacuum adapter of the present invention showing a nozzle end of a vacuum hose positioned inside a fireplace.

Shown in FIG. 1, the present invention is an ash vacuum adapter 10, hereinafter referred to as adapter. The end of a section of hose 11 is shown fitted onto an open end of an elbow coupling 12 that extends outwardly from a top surface of a lid 13. Lid 13 is shown fitted, so as to close over, an open top end of a cylindrical canister body 14, hereinafter referred to as canister.

Figure 2:
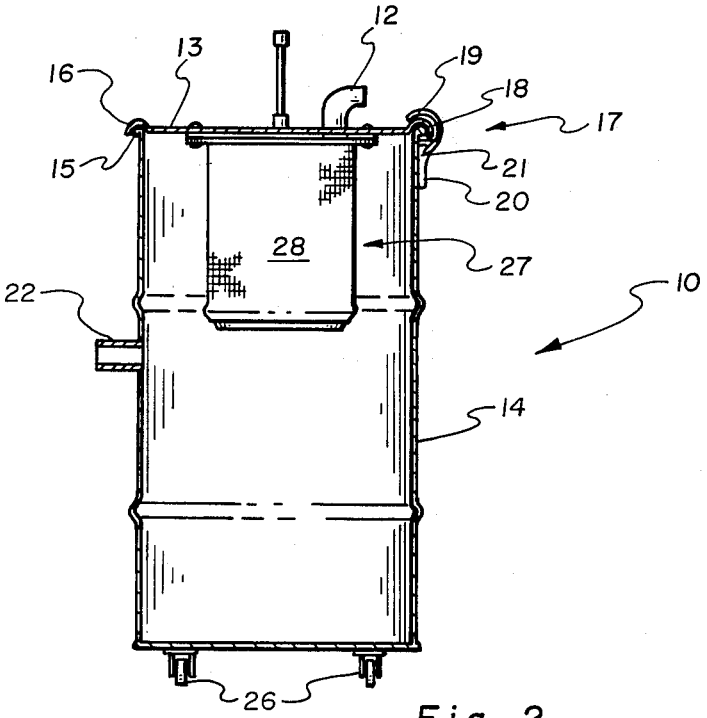
FIG. 2 is a sectional view of the ash vacuum adapter taken along the line 2—2 of FIG. 1.

As shown in FIG. 2, the canister 14 is preferably formed of a metal that is appropriate for containing even burning coals, and, in practice, a sixteen (16) gallon steel drum has been used successfully. Such steel drum includes a half round bead formed around a top open end thereof, which bead is for receiving, in sealing engagement, an accentuate lip 16, that is formed around the lid 13 edge. Shown in FIGS. 1 and 2, clamps 17 are provided to maintain, in sealing engagement, the lid 13 fitted over the open top end of canister 14. Which clamps 17 are shown spaced at equidistant points around and proximate to the canister open top end.

A preferred clamp 17 is like clamps that are commonly used on canister vacuums, shop vacuums, and like vacuum cleaners, where a top portion is releasably fitted over a canister open top. Like such clamps, clamp 12 preferably includes, as shown in FIG. 2, a body 18 that has a book 19 formed on one end, with a finger engaging bar 20 formed on the opposite end. The body 18 is mounted to the canister side at a pivot 21, which pivot is part of a latch mechanism mounted to the canister side. So arranged, when the bar 20 is pivoted away from the canister side, the hook 19 will lift off of the lid arcuate lip 16, allowing the body 18 to be rotated around pivot 21 away from that lid arcuate lip with clamp 17 in the attitude shown in FIGS. 1 and 2, the lid arcuate lip 16 is in sealing engagement to the canister half round bead 15. Of course, it should be understood, another latch arrangement can, within the scope of this disclosure, be employed to maintain the lid 13 in sealing engagement over the canister 14 open end. Such other arrangement could be barrel ring like that which is generally employed to attach a lid over a sixteen (16) gallon drum, or the like, within the scope of this disclosure.

Figure 3:
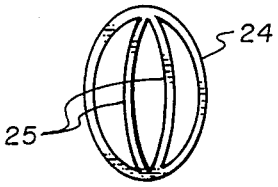
FIG. 3 shows an expanded end view of the nozzle of FIG. 1.

With the hose 11 connected to a vacuum source through the elbow coupling 12, and the lid 13 sealed over the canister 14 open end, a vacuum is available in that canister. This vacuum is available at a vacuum port 22 that is shown as a tube fitted through the side of the canister 14 extending outwardly from the canister side. Shown in FIG. 1, the vacuum port 22 receives one end of a vacuum hose 23 fitted thereover, a nozzle 24 shown extending from the opposite vacuum hose end. Shown in FIGS. 1 and 3, the nozzle 24 is preferably sloped to approximately a forty five (45) degree angle across an open end and includes a grid therein, shown as curved bars 25. The grid restricts the size of coals that will pass into the nozzle. In practice, the nozzle 24 is preferably manufactured from a heavy gauge steel with grid bars 25 welded thereacross, restricting passage to coals having one quarter inch diameter and less.

As set out above, when the hose 11 is connected to a vacuum source, a vacuum will be present in canister 14 to pull materials through the nozzle 24 and vacuum hose 23 into the canister. In practice, as the present invention is intended for use in cleaning ash and coals from a fireplace or wood burning stove, it may be that hot and even burning materials may be pulled therefrom. Accordingly, to avoid damage to the vacuum hose and to preclude ignition thereof, it is preferred that the vacuum hose be constructed from a flame retardant material. A hose manufactured from one hundred percent (100%) neoprene has been used as vacuum hose 23 but, of course, a hose fabricated from another flame retardant material could be used within the scope of this disclosure. Also, as the materials pulled into the canister 14 may be hot and even still burning, it is preferred to mount the canister 14 on rollers or casters 26, as shown in FIG. 2. So arranged, the canister bottom will be supported off of the floor, avoiding a potentially damaging heat transfer from the canister bottom thereto.

Figure 4:
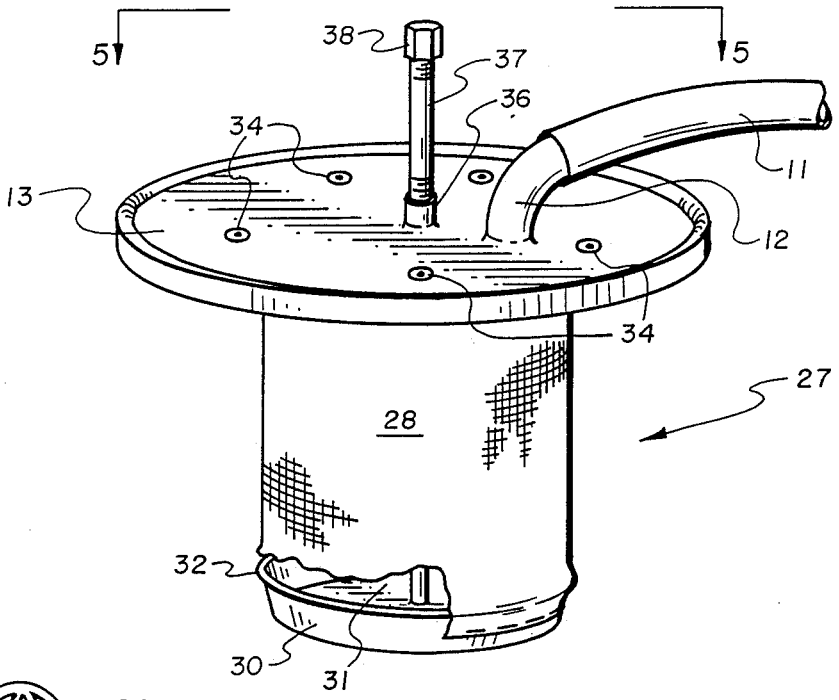
FIG. 4 is a side elevation view of the canister lid and filter removed from the canister body of FIG. 1, and shows a section of the filter sleeve removed along a lower edge thereof.
Figure 5:
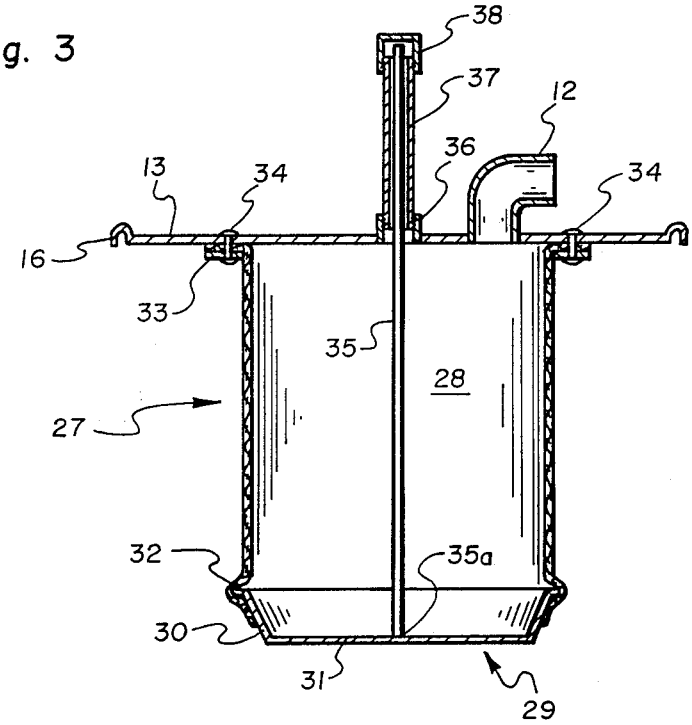
FIG. 5 is a side elevation sectional view taken along the line 5—5 of FIG. 2.

With a vacuum available through hose 11, to avoid passage of ash particles and dust from the canister 14, through hose 11, the present invention provides a collapsing filter 27. The collapsing filter 27, as shown best in FIGS. 4, 5 and 6, preferably consists of a cylindrical flexible fabric sleeve 28 mounted to a circular metal base 29. The cylindrical sleeve is preferably formed of a flame retardant or fireproof material to reduce a possibility of its damage or ignition from contact with hot or burning coals as may enter the canister 14. In practice, a thirteen and one half (13 ½) ounce fireproof material known as ATG, manufactured by Burlington, that has a highest temperature specification of twelve hundred (1200) degrees fahrenheit (F), has been used successfully to fabricate the filter cylindrical sleeve.

To form the collapsing filter 27, a circular metal base 29 is fitted across, to close off, the lower end of the cylindrical sleeve 28. To retain this coupling engagement, the circular metal base 29 is preferably dish-shaped having an outwardly slopping side wall 30 that extends from a flat plate base 31 and terminates in an outwardly projecting lip 32 that is formed around the side wall top edge. The lip 32, as shown best in FIG. 5, serves as a continuous bead for seating around the inner wall of the cylindrical sleeve 28 end. The upper end of the cylindrical sleeve 28 is secured to the undersurface of lid 13 by sandwiching it between that lid under surface and a lock ring 33. To maintain the sandwich coupling, connectors, shown as rivets 34, are fitted through the lock ring, cylindrical sleeve end, and lid, sealing the cylindrical sleeve end to the lid undersurface. While not shown, it should be understood that the lid 13 could also be manufactured from plastic to receive the cylindrical sleeve end bonded thereto as with an adhesive, within the scope disclosure.

Figure 6:
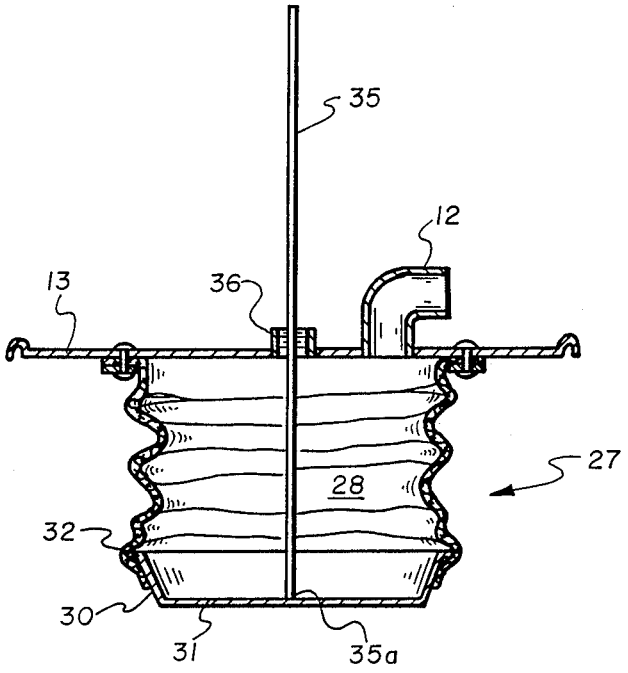
FIG. 6 is a view like that of FIG. 4, with a dew-rod and filter shown removed, showing the dew-rod drawn upwardly collapsing the filter sleeve upon itself.

As shown best in FIG. 6, the cylindrical sleeve 28 and circular metal base 29 thereby form the collapsing filter 27. So arranged, the collapsing filter 27 can be folded or accordioned upon itself and even moved from side to side for shaking off ash particles, and the like, as may adhere thereto. To provide for this movement, a dew-rod 35, that is shown best in FIG. 5 as a straight rod, is connected on its one end 35a to approximately a mid-point of the top surface of the flat base plate 31. The dew-rod extends at approximately a right angle from a mid-point on the flat base plate top surface, extending and projects through a collar 36 that is secured in lid 13. The dew-rod 35 opposite end is thereby available without the lid 13 for manual manipulation, to be moved up and down and even from side to side, as shown in FIG. 6, shaking collected ash dust therefrom.

During operation, it is necessary that a vacuum be maintained in canister 14. However, as set out above, the area between the inside wall of the collar 36 and side of the dew-rod 35, would be open, leaking air into the canister and lessening the vacuum therein. It is therefore desirable to close off this open area during operation. Accordingly, the present invention provides a closed sleeve 37 that is arranged to slide over the dew-rod 35 end, a threaded end. This closed sleeve includes a threaded end for turning internal threads of collar 36 providing a sealed coupling therebetween. Shown in FIG. 5, the closed sleeve 37 is a section of pipe that is threaded on both ends, with one end for turning into internal threads of collar 36, the other end to receive a cap 38 turned thereover. In practice, to shake collected ash particles off from the cylindrical sleeve 28, the closed sleeve 37 is turned out of engagement with the collar 36, exposing the dew-rod 35, that can then be manually moved up and down and from side to side. To avoid exhausting dust through the area between the dew-rod surface and collar wall, the vacuum source that is provided through hose 11 should be removed, or turned off, prior to removing the closed sleeve 37. Of course, another arrangement for closing the area between the dew-rod 35 and collar 36 interior wall, other than closed sleeve 37, could be employed. For example, a holed stopper, arranged to slide along the dew-rod 35 and into collar 36, or the like, could be so employed within the scope of this disclosure.

While a preferred form of our invention has been shown and described herein, it should be understood that the present disclosure is made by way of example only and that variations are possible without departing from the subject matter, and equivalency thereof, coming within the scope of the following claims, which claims we regard as our invention.

We claim:

1. An ash vacuum adapter comprising, a cylindrical drum housing having a closed bottom and open top ends; lid means for fitting in sealing engagement over said cylindrical housing open top end; a vacuum source and means consisting of a tubular coupling fitted and secured through said lid means for connecting said vacuum source into said cylindrical drum housing; a vacuum hose for connection into said cylindrical housing at its one end with a nozzle means fitted to the other vacuum hose end; and a filter means for mounting in said cylindrical drum housing, such that said vacuum source pulls air therethrough, which filter means consists of, an open flexible sleeve, base means for closing off a bottom end of said flexible sleeve, means for securing the top end of said flexible sleeve to said lid means within said cylindrical housing consisting of a flat ring and connection means for sandwiching said open top end of said flexible sleeve against the undersurface of said lid means, and dew-rod means that extends into said cylindrical housing and connects to said base means, said dew-rod means for manual manipulation to accordian and shake said flexible sleeve.

2. An ash vacuum adapter as recited in claim 1, wherein the nozzle means is an open metal tube arranged for coupling on one end to the vacuum hose and includes a grid means formed across its opposite end for limiting, to less than a certain width, coals pulled therethrough.

3. An ash vacuum adapter as recited in claim 1, wherein the vacuum hose is formed from a flame retardant neoprene hose material.

4. An ash vacuum adapter as recited in claim 1, further including caster means secured to the cylindrical housing closed end for supporting said cylindrical housing.

5. An ash vacuum adapter comprising, a cylindrical housing having a closed bottom and open top ends; lid means for fitting over said cylindrical housing open top end; a vacuum source and means for connecting it into said cylindrical housing; a vacuum hose for connection into said cylindrical housing at its one end with a nozzle means fitted to the other vacuum hose end; and a filter means for mounting in said cylindrical housing, such that said vacuum source pulls air therethrough, which filter means consists of, an open flexible sleeve formed of a flame proof material, base means for closing off a bottom end of said flexible sleeve that consists of a dish shaped circular plate having side walls that slant upwardly and outwardly and terminate in a lip means for fitting snugly within an end of said flexible sleeve end, means for securing the top end of said flexible sleeve within said cylindrical housing, and dew-rod means that extends into said cylindrical housing and connects to said base means, said dew-rod means for manual manipulation to accordion and shake said flexible sleeve.

6. An ash vacuum adapter comprising, a cylindrical housing having a closed bottom and top ends; lid mean for fitting over said cylindrical housing open top end; a vacuum source and means for connecting it into said cylindrical housing; a vacuum hose for connection into said cylindrical housing at its one end with a nozzle means fitted to the other vacuum hose end; and a filter means for mounting in said cylindrical housing, such that said vacuum source pulls air therethrough, which filter means consists of, an open flexible sleeve formed of a flame proof material, base means for closing off a bottom end of said flexible sleeve that consists of a circular plate having side wall means for fitting snugly within an end of said flexible sleeve end,means for securing the top end of said flexible sleeve within said cylindrical housing, and dew-rod means that is a straight rod that extends into said cylindrical housing within said flexible sleeve and connects to said base means on one end and projects through an open collar that is secured in said lid means, which said open collar includes a sleeve means for coupling thereto that is for fitting over the portion of said other straight rod end that extends above said lid means.

* * * * *